US005896634A

United States Patent [19]

Brodowski et al.

[11] Patent Number: 5,896,634

[45] Date of Patent: Apr. 27, 1999

[54] SIZING AGENT-FREE TANGLED MULTIFILAMENT YARN AND PROCESS FOR ITS MANUFACTURE

[75] Inventors: Walter Brodowski, Amorbach; Hermann Klotz, Mömlingen; Albert Giesen, Heinsberg, all of Germany

[73] Assignee: Akzo Nobel nv, Arnhem, Netherlands

[21] Appl. No.: 08/782,287

[22] Filed: Jan. 13, 1997

[30] Foreign Application Priority Data

Jan. 13, 1996 [DE] Germany ..... 196 01 030

[51] Int. Cl.[6] ..... B65H 71/00

[52] U.S. Cl. ..... 28/178; 28/140

[58] Field of Search ..... 28/178, 181, 179, 28/183, 180, 182, 140; 139/426 R; 428/364, 365, 378, 383, 394

[56] References Cited

U.S. PATENT DOCUMENTS

| | | | |
|---|---|---|---|
| 3,885,277 | 5/1975 | Schutz et al. . | |
| 4,207,729 | 6/1980 | Exbrayat et al. . | |
| 4,773,136 | 9/1988 | Seydel et al. | 28/179 |
| 4,800,117 | 1/1989 | Marshall . | |
| 4,859,509 | 8/1989 | Hasuly et al. | 28/178 |
| 5,421,377 | 6/1995 | Bönigk . | |

FOREIGN PATENT DOCUMENTS

| | | |
|---|---|---|
| A 2 312 579 | 12/1976 | France . |
| 43 27 371 | 2/1995 | Germany . |
| A 51-035722 | 3/1976 | Japan . |
| 52-63334 | 5/1977 | Japan . |
| 61-194249 | 8/1986 | Japan . |
| A 63-105142 | 5/1988 | Japan . |
| 41-63336 | 6/1992 | Japan . |
| A 04-209843 | 7/1992 | Japan . |

*Primary Examiner*—Diana L. Biefeld
*Assistant Examiner*—Larry D. Worrell, Jr.
*Attorney, Agent, or Firm*—Oliff & Berridge, PLC

[57] ABSTRACT

Sizing agent-free tangled multifilament yarn with an opening length of 1 to 6 cm and a knot strength of no more than 2, at least the majority of whose filaments have a thin film consisting mainly of hard wax constituting about 0.3 to 2% of the total weight of the filaments together with this film, and are glued, at least in places, via this film to adjacent filaments.

10 Claims, 1 Drawing Sheet

SIZING AGENT-FREE TANGLED MULTIFILAMENT YARN AND PROCESS FOR ITS MANUFACTURE

BACKGROUND OF THE INVENTION

1. Field of the Invention

The invention relates to a sizing agent-free tangled multifilament yarn.

2. Description of Related Art

Tangled multifilament yarns are sufficiently familiar. They are generally manufactured by means of blowing with a fluid, preferably air. The disadvantage of normal tangled multifilament yarns is that they lend themselves only conditionally to subsequent processing. For example, if tangled multifilament yarns are employed as warp yarns in weaving, they are subject to a large number of stresses, as portrayed in detail in the introduction to DE-A-43 27 371. In order to limit these stresses such that as few disruptions as possible arise during weaving, this specification recommends the use of stabilized sizing agent-free multifilament yarns. All multifilament yarns are considered to be stabilized which, under the warp thread tensions occurring as a result of the stresses on the loom and even in the plain weave L1/1, which is classified as particularly critical, can be worked with practically no disruptions with high end spacing, e.g., with an end spacing of 40/26 threads per cm warp/weft, not only on traditional loom systems, but most especially on modern loom systems based on weft insertion via air or water. According to DE-A-43 27 371, all yarns which only possess protective twist and which are rubbed, heat-sealed, glued, melted together or, more especially, intermingled, are suitable for use as stabilized multifilament yarns. In order to weave the yarns described therein, care must be taken that the thread tension of the multifilament yarn does not exceed 1 cN/dtex throughout the processing and until it passes through the weaving reed. Thus, in DE-A-43 27 371, no mention is made of a special method by which a multifilament can be especially well stabilized, but instead it is pointed out that evidently the usual yarns can be used, as long as the thread tension of the yarns is selected low enough during subsequent processing. However, since the thread tensions in looms, especially in looms based on weft insertion via air or water, are predetermined by the construction of the machine and can only be influenced to a small degree, the method suggested therein seems hardly to be practicable.

Another well-known method of making multifilament yarns suitable for weaving consists of providing the multifilament yarns with sizing agents in a separate step prior to weaving, which must, however, be washed out of the finished fabric again after weaving. JP-A-52 63 334 makes known, for example, the method of initially tangling the multifilament yarns in order to obtain an opening length of 2 to 5 cm (20 to 50 knots per meter), after which they are provided with sizing agent amounting to 0.5 to 3%. As a separate process step is necessary for applying the sizing agent, i.e., sizing cannot be combined with the process steps required for manufacturing and subsequent processing, sized yarns are very expensive to manufacture. As already explained, an additional step, namely, removal of the sizing agent, is also required after weaving. In addition, in a further expensive step, the sizing agent must then be removed from the washing water in order to protect the environment.

Furthermore, JP-A-41 63 336 makes known the method of adding waxes such as carnauba wax, beeswax or candelilla wax to the sizing agent which is applied to the tangled multifilament yarns. By mixing sizing agent with wax, however, processing the washing water with which the sizing agent is washed out of the finished fabric, becomes even more expensive.

SUMMARY OF THE INVENTION

An object of this invention is at least to reduce the disadvantages described above.

This task is solved by a sizing agent-free tangled multifilament yarn with an opening length of 1 to 6 cm and a knot strength of no more than 2, at least the majority of whose filaments have a thin film consisting mainly of hard wax constituting about 0.3 to 2% of the total weight of the filaments together with this film, and are glued, at least in places, via this film to adjacent filaments.

BRIEF DESCRIPTION OF THE DRAWINGS

The invention will be described in conjunction with the following drawing wherein.

DETAILED DESCRIPTION OF PREFERRED EMBODIMENTS

Figure 1:
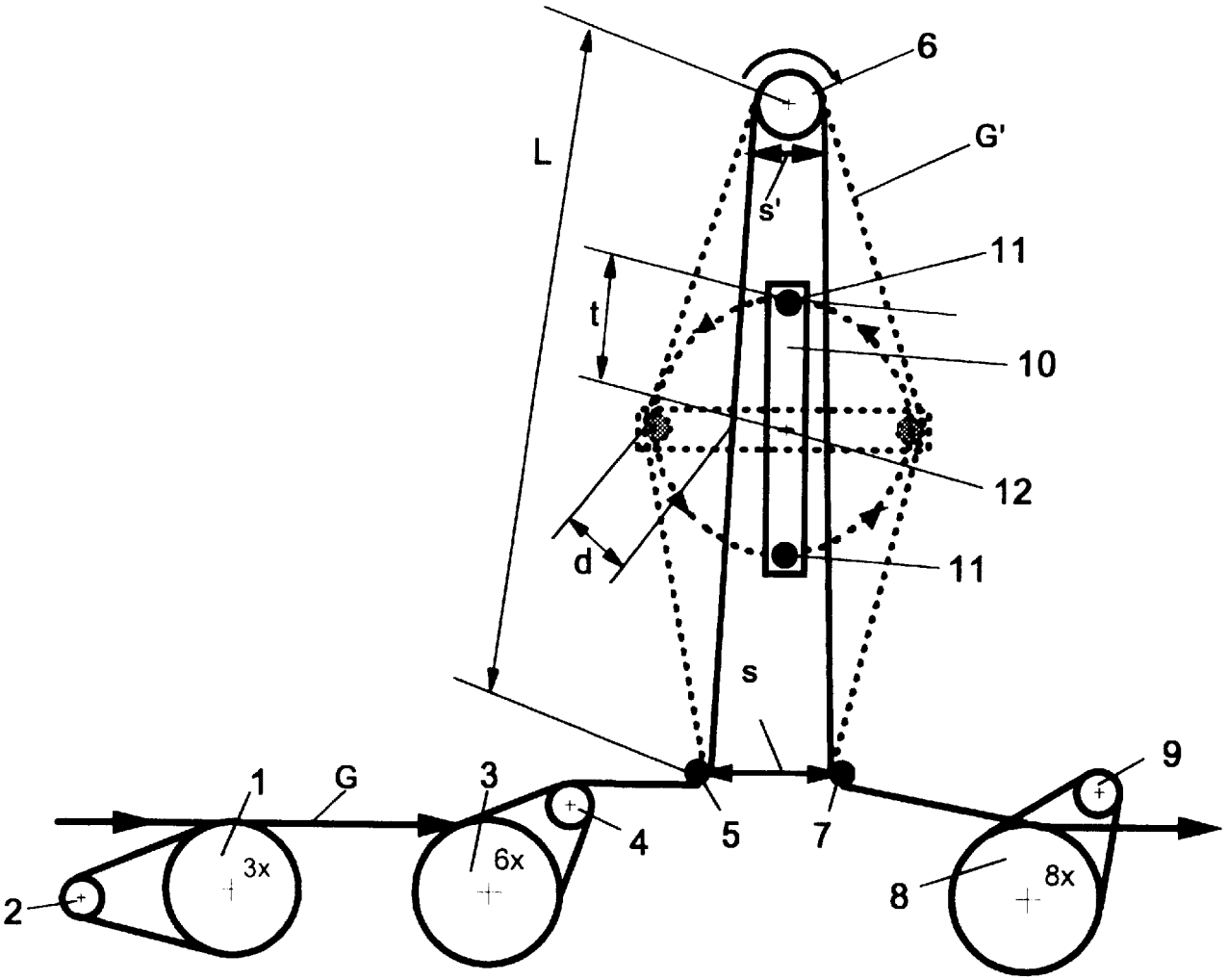
FIG. 1 is a schematic depiction of an embodiment of the invention.

It is surprising to discover that the use of hard wax in tangled multifilament yarns alone results in good stabilization of these yarns. The knot strength is considered to be a measure of the quality of the stabilization.

The knot strength of a multifilament yarn is determined in the following manner, with reference to FIG. 1. The opening length T1 of a previously tangled multifilament yarn is first determined with a Rothschild Entanglement Tester NPT R-2070. Next, a bobbin (not shown) with the tangled multifilament yarn is fed to a device which simulates the stress in the weaving shed. For this purpose the yarn G is drawn off via an inflow galette 1 with separation roller 2 at a rate of 52.5 m/min., guided over a second galette 3 with separation roller 4 at a rate of 55 m/min., and then displaced via two thread guides 5 and 7 and a guide roller 6 in an elongated U. The length L of the arms of the U is 40 cm, while the separation between the arms of the elongated U is set to s=60 mm in the region between the thread guides 5 and 7 and to s'=25 mm in the region of the guide roller 6. After leaving the unshaped section, the yarn G is drawn off at a rate of 57.5 m/min. by a third galette 8 with separation roller 9. The numbers marked on galettes 1, 3 and 8 (3x, 6x and 8x respectively) signify that the yarn is looped repeatedly around the respective galette and its separation roller the equivalent number of times. For example, the yarn is placed around galette 3 and separation roller 4 so that the yarn loops around galette 3 and separation roller 4 six times.

Between the two arms of the elongated U, there is a central pivotally mounted beam 10 at both of whose ends a pin 11 made from ceramics (available under the commercial name Degussit) is arranged in such a fashion that when the beam 10 rotates, the yarn G is displaced by displacement d. The position of the yarn at maximum displacement is drawn with a dashed line and labeled G'. In the same way, beam 10 and the pins 11 in the position at which the yarn G is maximally displaced are drawn with dashed lines. Here, each separation t between pin 11 and axis 12 is 7.5 cm. While the yarn is drawn in a U shape through the measurement device, beam 10 is caused to rotate, whereby a constant rate of rotation of 100 l/min. is maintained. Next, the yarn G is wound on the bobbin again (not shown). The opening length T2 of this yarn G is determined in the same way as described above. The knot strength is hence determined as the quotient of T2 to T1.

Since generally by means of the dynamic stress applied to the yarn via pins 11 the opening length T2 of the yarn G is larger than the opening length T1 prior to treatment, values for the knot strength larger than 1 are generally obtained. However, it has also been observed that by means of the grazing stress of the ceramic pins 11, a shortening, albeit a slight one, of opening length T2 relative to T1 can occur. Thus generally values of more than 1, and in exceptional cases, values of 1 or less were determined in the measurement of the knot strength. In the experiments conducted to date, values of 0.8 or more were obtained.

Knot strength values of less than 1.0, such as 0.9 or 0.8, show clearly that among the yarns of the invention there are also yarns whose filament cohesion even improves during subsequent processing, for example, during weaving. Values of 1.0 for knot strength mean that the yarns behave in an extremely stable fashion during weaving, while the higher the knot strength value, the more the stability of the yarns increases and the lower the frequency of disruptions becomes.

It was surprising to discover that when weaving the yarns according to the invention, which are preferably used as warp yarns, practically no, or at any rate very few, thread breaks or other disruptions are seen during the weaving process, if by means of the hard waxes in the quantity specified according to the invention, a knot strength of less than 2, preferably less than 1.5, is set. Using conventional sizing agents such low values are almost impossible to achieve or can only be achieved at high cost, as will be shown below with the help of examples.

Here, multifilament yarns with a knot strength of 0.9 to 1.5 are preferably used.

Natural and synthetic hard waxes are suitable for the stabilization of tangled yarns. Among the synthetic hard waxes, polyethylene waxes and mixtures of the same with various molecular weights, which have been made well emulsifiable by means of aftertreatment processes with an oxidizing effect, are particularly worthy of mention.

Also suitable are mixtures of those hard waxes which do not cancel their hard wax properties. Thus, other components can also be admixed with the hard waxes, whereby the type and amount of the component must be selected such that the mixture obtained displays the typical properties of a hard wax. Soft waxes, such as beeswax, paraffin or usual textile wax, such as polyethylene oxide, cannot be used for the yarns according to the invention. However, they can be added to the hard wax employed according to the invention, in such small quantities that the latter do not lose their hard wax properties.

Other substances can also be admixed with the hard waxes employed according to the invention, such as smoothing agents or mixtures of viscous components. The hard waxes employed according to the invention or mixtures with hard waxes certainly contain no sizing agent, whose disadvantages were already described at the beginning. Although one skilled at the art is familiar with the usual sizing agents, usual sizing agents will be listed below. Usual sizing agents are agents such as those also described, for example, in JP-A-41 63 336, which are water-soluble and contain reaction products consisting of terephthalic or isophthalic acid, polyoxyethylene glycol, ethylene glycol, butylmethacrylate, laurylmethacrylate or mixtures of these.

The multifilament yarn according to the invention is particularly characterized by the fact that the film of the filaments consists of carnauba wax or synthetic hard wax, such as polyethylene wax. It is beneficial for the needle penetration of the hard waxes used, measured according to DIN 51579, to have values between <1 and 20. It is beneficial if these hard waxes have a melting range in the range of 65 to 120° C.

The task facing the invention is also solved by a method of manufacturing a multifilament yarn of this kind, in which the multifilament yarn is tangled, then moistened with a yarn cohesion agent and then wound up, which is characterized in that for the yarn cohesion agent, an aqueous emulsion is used which contains 10 to 20, preferably about 15 percent by weight, relative to the total weight of the emulsion, of a hard wax which may contain further additions such as emulsifiers, smoothing agents and/or anti-tack agents.

When the process of the invention is used it is not even necessary (leaving aside a few exceptions) to provide for a drying process after application of the emulsion and prior to winding up. In most cases, the thread rate during tangling is sufficient for the ambient air to remove so much moisture from the yarn covered with the emulsion that the now wound up yarn no longer sticks to adjacent yarn layers. The application can be included in a process normally present in manufacture. For instance, whenever tangling of the yarn is to take place at the end of the spinning process in the manufacture of POY or HOY yarns, treatment with the aqueous emulsion can take place directly following the tangle jet and prior to winding. The process according to the invention can therefore especially be applied as a process step integrated or capable of integration into the normal manufacture or subsequent processing of a yarn.

The process according to the invention is especially characterized by the fact that carnauba wax or synthetic hard wax such as polyethylene wax can be selected as the hard wax. Hard waxes with a needle penetration of <1 to 10 are especially preferred.

These waxes have admittedly already been employed in yarn processing, although these waxes were merely employed as additions to the familiar sizing agents, as proved by the specification JP-A-4163336 already mentioned above. It is surprising that now it has been discovered that excellently well stabilized multifilament yarns can be obtained without the use of sizing agent, merely by employing hard waxes. By this means, the expensive sizing process is no longer required. Since generally no drying is necessary either, the process according to the invention is also particularly economical. As sizing agent is no longer required, the process according to the invention is also particularly environmentally friendly.

The use of waxes is also, for example, known in blended yarns, as found in JP-A-61 194 249. In this specification, for yarns textured with false twist which consist of various groups of multifilament yarns, natural waxes are added to the same in order to improve their weavability. This may be possible for yarns textured with false twist. However, in the scope of this invention it was discovered that among the natural waxes recommended in JP-A-61 194 249, when used on tangled yarns the wool waxes and the paraffin waxes practically do not possess the stability required for the weaving process.

The invention will be explained in more detail with reference to the following examples.

EXAMPLES 1–12

Polyester cop yarns with a total titer of 150 dtex and 48 single filaments, containing a matting agent and with a round cross-section were used. These polyester cop yarns were coated using a ceramic jet with different quantities of 1% wax/emulsifier mixture and wound with no further drying. The drawing-off rate was 137 m/min., the distance between the location where coating was carried out (ceramic jet) and the winding was about 1 m. The aqueous wax emulsion employed had an active ingredient concentration of 6%.

After several days of conditioning in the air conditioning cabinet at 22° C. and 62% relative humidity, the treated yarns and for comparison the feed yarn were subjected to the extension-abrasion test described and the knot strength calculated as the ratio of the opening lengths T2 after and T1 prior to loading. The wax/emulsifier mixtures employed and the results of the measurements are given in Table 1. Here, in Examples 1 and 2 textile wax and paraffin wax respectively were employed, i.e., in both cases a wax which gives rise to a multifilament yarn which is not in accordance with the invention. Therefore, Examples 1 and 2 are comparative examples. In example 10, the proportion of hard waxes sunk below 0.3% so that here, too, a sufficient knot strength was not achieved. This is also a comparative example.

In the column headed Example in Table 1 the comparative examples are marked with (C). The column headed "T2/T1 without" shows the knot strength of the original yarn, i.e., the yarn not given a coating. All percentage values in the examples and in the table are relative to the total weight of the respective yarn. The waxes used are denoted in Table 1 with figures set in brackets. The description of the waxes is given below Table 1.

When the multifilament yarns according to Examples 1 and 2 were used as warp yarns, frequent breaks occurred during weaving, whereas when multifilament yarns according to each of Examples 3 to 11 were used as warp yarns, practically no breaks occurred.

The multifilament yarns according to the invention, which as described above were stabilized with suitable hard waxes to the level stated, can be processed as warp yarns to woven fabrics on traditional looms to good effect.

TABLE 1

| Example | Wax | T2/T1 without | Applied % | Opening length T1 mm | Opening length T2 mm | Knot strength T2/T1 |
|---|---|---|---|---|---|---|
| 1 (C) | (1) | 5.1 | 1.0 | 20.6 | 107 | 5.19 |
| 2 (C) | (2) | 5.1 | 1.0 | 20.8 | 119 | 5.72 |
| 3 | (3) | 6.1 | 1.0 | 20.8 | 15.4 | 0.74 |
| 4 | (3) | 6.1 | 0.66 | 19.6 | 25.8 | 1.32 |
| 5 | (3) | 6.1 | 0.33 | 23.8 | 42.4 | 1.78 |
| 6 | (4) | | 1.0 | 25.9 | 25.5 | 0.98 |
| 7 | (5) | | 1.0 | 17.4 | 19.9 | 1.15 |
| 8 | (6) | 3.6 | 1.5 | 17.5 | 19.0 | 1.08 |
| 9 | (6) | 3.6 | 1.0 | 15.7 | 25.3 | 1.61 |
| 10 (C) | (6) | 3.6 | 0.66 | 16.5 | 41.9 | 2.5 |
| 11 | (7) | 3.6 | 1.0 | 20.6 | 25.4 | 1.23 |
| 12 | (7) | 3.6 | 0.66 | 15.0 | 22.7 | 1.51 |

(1) Textile wax P, polyglycol ether (MW 600) with wax-like properties, manufactured by BASF.
(2) Paraffin emulsion C, a mixture of 30 parts paraffin (melting pt. 51–53° C.), tallow alcohol × 6 E0, spin finish K 7334 (Stockhausen) and 10 parts aerosol OT (Cyanamid), respectively.
(3) Aquacer 611, 35%, non-ionogenic emulsion of carnauba wax in water, manufactured by BYK-CERA bv; melting pt. 80–90° C. (Lit.)
(4) 50% (1) and 50% (3)
(5) Two parts (3) and one part Rewopal TA 25 S, tallow alcohol × 25 EO, manufactured by REWO/WITCO.
(6) Ultralube W-388, 30% non-ionogenic emulsion consisting of about 15 parts polyethylene waxes with various hardnesses and about 15 parts paraffin (melting pt./solid matter about 96° C.).
(7) Ultralube W-389, analogous to W-388, but melting pt. of solid matter about 105° C., manufactured by KEIM-ADDITEC

EXAMPLES 13–16

In these examples, it is shown that the use of sizing agents to which a hard wax is added, as described in JP-A 41 63 336, gives a poorer result than the use of hard wax without sizing agent.

Wax (3) was again used as the hard wax. For the sizing agent, a reaction product consisting of terephthalic acid, sulfoisophthalic acid and glycols which can be obtained from Eastman under the name LB 100, was used. For the yarn, the yarn used in the previous examples was again used. The values for the original yarn have been included in the table under the heading "yarn". The quantity applied and the knot strength is shown in Table 2.

TABLE 2

| Example | Size mixture Hard wax % | Size % | Applied % | Knot strength T2/T1 |
|---|---|---|---|---|
| Yarn | 0 | 0 | 0 | 3.1 |
| 13 | 0 | 100 | 1 | 1.2 |
| 14 | 25 | 75 | 1 | 1.8 |
| 15 | 50 | 50 | 1 | 2.7 |
| 16 | 100 | 0 | 1 | 1.03 |

When comparing the data contained in Table 2, it emerges that the knot strength becomes poorer the larger the proportion of hard wax in the size is. It is thus all the more surprising to find that when only hard wax is applied, practically better knot strength is achieved than with sizing agent alone. If the yarn is drawn off the finished yarn package at a rate of 100 m/min., for the yarn according to Example 13, strongly varying stresses arise in the range of 0.63 to 1.06 cN, whereas for the yarn according to example 16 stresses only in the range of 0.25 and 0.3 cN were measured. Here, too, it becomes clear that the yarns treated with hard waxes according to the invention offer decided advantages.

What is claimed is:

1. A sizing agent-free tangled multifilament yarn, comprising a plurality of sizing agent-free tangled filaments and a hard wax, wherein said hard wax is only on an exterior of at least a majority of said plurality of filaments as part of a film consisting mainly of said hard wax;

said hard wax constitutes about 0.3 to 2% of a total weight of the filaments together with the film;

adjacent filaments of said at least a majority of said plurality of filaments are glued together, at least in places, via the film; and said multifilament yam has an opening length of 1 to 6 cm and a knot strength of not more than 2.

2. The multifilament yarn according to claim 1, wherein the not strength is not more than 1.5.

3. The multifilament yarn according to claim 1, wherein the film consists at least mainly of carnauba wax or a polyethylene wax.

4. The multifilament yarn according to claim 1, wherein the hard wax has a needle penetration of less than 1 to 20, measured according to DIN 51579.

5. A process for manufacturing the multifilament yarn according to claim 1, comprising:

tangling a plurality of filaments;

moistening said tangled filaments with a yarn cohesion agent; and winding-up the moistened filaments to form said multifilament yarn according to claim 1;

wherein the yarn cohesion agent is an aqueous emulsion comprising 10 to 20 percent by weight, relative to a total weight of the emulsion, of an emulsion hard wax.

6. The process according to claim 5, wherein the yarn cohesion agent further comprises at least one of an emulsifier, a smoothing agent and an anti-tack agent.

7. The process according to claim 5, wherein the emulsion contains about 15 percent by weight, relative to the total weight of the emulsion, of the emulsion hard wax.

8. The process according to claim 5, wherein the emulsion hard wax is carnauba wax or polyethylene wax.

9. The process according to claims 5, wherein the emulsion hard wax is a natural or synthetic wax with a needle penetration of less than 1 to 20, measured according to DIN 51579.

10. A method for producing textiles using the multifilament yarn of claim 1, comprising:

tangling a plurality of filaments;

moistening said tangled filaments with a yarn cohesion agent; and winding up the moistened filaments to form said multifilament yarn;

the method further including forming a textile material from said multifilament yarn.

* * * * *